US007599640B2

(12) United States Patent
Sato

(10) Patent No.: US 7,599,640 B2
(45) Date of Patent: Oct. 6, 2009

(54) DEVELOPER CARTRIDGE, PROCESS UNIT, AND IMAGE FORMING DEVICE

(75) Inventor: Fumikazu Sato, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 490 days.

(21) Appl. No.: 11/565,025

(22) Filed: Nov. 30, 2006

(65) Prior Publication Data

US 2007/0122176 A1 May 31, 2007

(30) Foreign Application Priority Data

Nov. 30, 2005 (JP) ..... 2005-346131

(51) Int. Cl.
*G03G 15/00* (2006.01)
*G03G 21/16* (2006.01)
*G03G 15/08* (2006.01)

(52) U.S. Cl. ..... 399/90; 399/111; 399/119

(58) Field of Classification Search ..... 399/90, 399/119, 107, 111
See application file for complete search history.

(56) References Cited

U.S. PATENT DOCUMENTS 6,041,203 A 3/2000 Suzuki et al.
6,256,467 B1 7/2001 Yakomori et al.
6,272,299 B1 8/2001 Numagami et al.
6,330,410 B1 12/2001 Okabe et al.
6,349,186 B1 * 2/2002 Park et al.
6,389,250 B1 5/2002 Numagami et al.
6,507,386 B2 1/2003 Inomata
7,327,970 B2 * 2/2008 Moon ..... 399/111
2005/0047814 A1 * 3/2005 Kawai ..... 399/90

* cited by examiner

*Primary Examiner*—Susan S Lee
(74) *Attorney, Agent, or Firm*—Banner & Witcoff, LTD

(57) ABSTRACT

A developer cartridge is attachable to and detachable from an image forming unit. The developer cartridge includes a developer carrier, an input gear rotatable about a rotating axis, the input gear communicating with the developer carrier, an electrode member that is electrically connected with the developer carrier, the electrode member including a first contact where the electrode member contacts a power supply member provided in the image forming unit, a supported member that includes a second contact where the supported member is supported by a supporting member provided in the image forming unit, an imaginary plane orthogonal to the rotating axis of the input gear is defined, the input gear, the electrode member, and the supported member being projected in the imaginary plane, and an imaginary line that connects the first contact and the second contact in the imaginary plane is defined. The imaginary line passes the input gear on the imaginary plane, and the input gear is located between the first contact and second contact in the imaginary plane.

13 Claims, 10 Drawing Sheets

DEVELOPER CARTRIDGE, PROCESS UNIT, AND IMAGE FORMING DEVICE

CROSS REFERENCE TO RELATED APPLICATION

This application claims priority from Japanese Patent Application No. 2005-346131 filed in Japan on Nov. 30, 2005, whose contents are expressly incorporated by reference.

FIELD

One or more aspects of this disclosure relate to an image formation device, a developer cartridge, and a process unit to be provided in the image formation device.

BACKGROUND

An image formation device may include an attachable and detachable drum cartridge including a photoconductive drum. To the drum cartridge, a developer cartridge including a developer roller is removably attached.

A developer cartridge is formed with a supported member, which is supported by a supporting member provided to the drum cartridge. The developer cartridge includes an input gear and an electrode member. The input gear receives a rotation force from a drive gear provided to the device body of the image formation device. The electrode member is supplied a bias from a power supply member to a developer roller. The electrode member contacts the power supply member, provided to the device body, and then a bias is supplied from the power supply member to the electrode member.

By the supported member of the developer cartridge being supported by a supporting member of the drum cartridge, the developer cartridge is attached to the drum cartridge with a predetermined positioning, and the developer roller faces and contacts the photoconductive drum. When the developer cartridge and the drum cartridge are positioned in the device body, the input gear meshes with the drive gear, and the electrode member contacts the power supply member. When forming an image, a rotation force from the drive gear to the input gear is transmitted to the developer roller via a gear mechanism so that the developer roller is rotated. A bias from the power supply member is also transmitted to the developer roller via the electrode member. As such, toner is carried on the surface of the developer roller. Next, toner is transferred to the surface of the photoconductive drum so that an electrostatic latent image formed on the surface of the photoconductive drum is developed into a toner image. This toner image is transferred to a paper, which is provided between the photoconductive drum and a transfer roller. The toner transferred onto the paper is then fixed so that the image is formed on the paper.

One potential problem with a conventional configuration is that the positioning of the developer cartridge is unsteady. That is, when a rotational moment is applied to the developer cartridge in response to a rotation force from the drive gear to the input gear, a thrust force from the supported member to the supporting member is not balanced with a thrust force from the electrode member to the power supply member. This is at least one reason why the positioning of the developer cartridge is unsteady.

SUMMARY

This summary is provided to introduce a selection of concepts in a simplified form that are further described below in the Detailed Description. This summary is not intended to identify key features or essential features of the claimed subject matter.

According to one or more illustrative aspects of present invention, a developer cartridge can be attachable to and detachable from an image forming unit. The developer cartridge may include a developer carrier, an input gear rotatable about a rotating axis, with the input gear communicating with the developer carrier. The developer cartridge may further include an electrode member that is electrically connected with the developer carrier, where the electrode member includes a first contact such that the electrode member contacts a power supply member provided in the image forming unit. The developer cartridge may further include a supported member that includes a second contact where the supported member is supported by a supporting member provided in the image forming unit. An imaginary plane orthogonal to the rotating axis of the input gear can be defined and includes projections of the input gear, the electrode member, and the supported member. An imaginary line may further be defined that connects the first contact and the second contact on the imaginary plane. The imaginary line passes the input gear on the imaginary plane, and the input gear may be located between the first contact and second contact on the imaginary plane.

According to other illustrative aspects of present invention, a process unit can be attached to and detached from an image formation device. The process unit may include a drum unit supporting at least one of image carrier, a power supply member, a supporting member, and a developer cartridge. The developer cartridge is attachable to and detachable from the drum unit. The developer cartridge includes a developer carrier. The developer cartridge may also include an input gear rotatable about a rotating axis, where the input gear communicates with the developer carrier. The developer cartridge may further include an electrode member that is electrically connected with the developer carrier, where the electrode member includes a first contact where the electrode member contacts a power supply member. The developer cartridge may further include a supported member that includes a second contact where the supported member is supported by a supporting member. The developer cartridge may further include an imaginary plane orthogonal to the rotating axis of the input gear. The imaginary plane may include projections of the input gear, the electrode member, and the supported member. An imaginary line connects the first contact and the second contact in the imaginary plane. The imaginary line passes the input gear on the imaginary plane, and the input gear is located between the first contact and second contact on the imaginary plane.

According to further illustrative aspects of present invention, an image formation device may include a body, at least one of image carrier supported at the body, a power supply member, a supporting member, and a developer cartridge. The developer cartridge is attachable to and detached from the image formation device. The developer cartridge includes a developer carrier, an input gear rotatable about a rotating axis, the input gear communicating with the developer carrier. The developer cartridge may further include an electrode member that is electrically connected with the developer carrier, where the electrode member includes a first contact where the electrode member contacts the power supply member. The developer carrier may further include a supported member that includes a second contact where the supported member is supported by the supporting member. An imaginary plane may be defined as orthogonal to the rotating axis of the input gear. The imaginary plane may include projections of the input gear, the electrode member, and the supported member. An imaginary line may connect the first contact and the second contact on the imaginary plane. The imaginary line passes the input gear on the imaginary plane, and the input gear may be located between the first contact and second contact on the imaginary plane.

DETAILED DESCRIPTION

One or more aspects of the invention relate to providing stable support of at least one of a developer cartridge or image carrier.

It is noted that various connections are set forth between elements in the following description. It is noted that these connections in general and, unless specified otherwise, may be direct or indirect and that this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other system for transferring toner. For the purposes of explanation, various drums and rollers are used. However, it is appreciated that other types of systems may be used with aspects of the invention.

1. General Configuration

Figure 1:
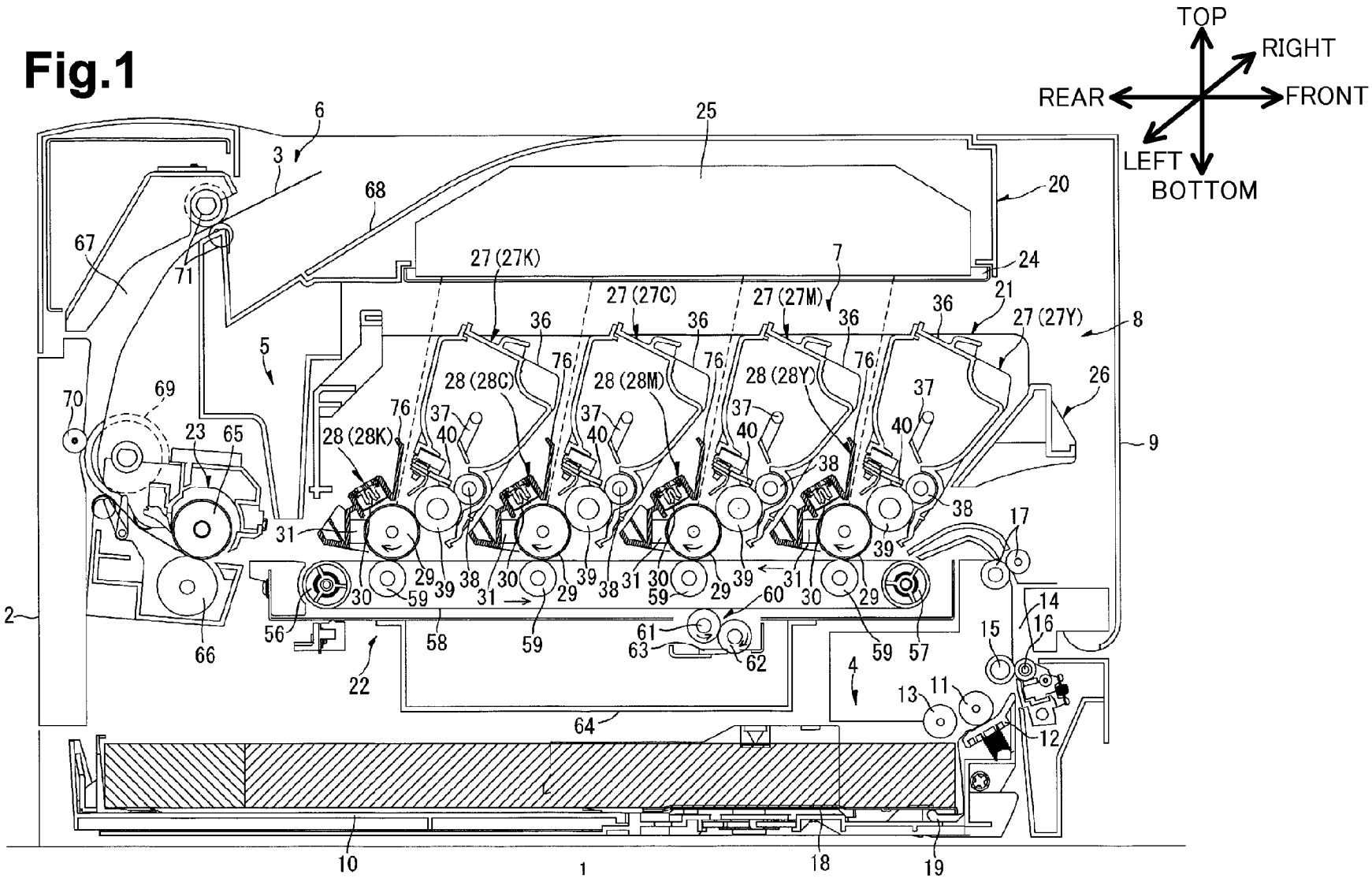
FIG. 1 is cross sectional side view showing an illustrative embodiment of an image formation device in accordance with aspects of the present invention.

FIG. 1 is a cross sectional side view of an illustrative embodiment of an image formation device.

A color laser printer 1 may be a tandem-type color laser printer, including a plurality of drum sub units 28 (described below) arranged in parallel in the horizontal direction. A body casing 2 includes therein a paper feed section 4, an image formation section 5, and a paper ejection section 6. The paper feed section 4 is provided for feeding paper 3. The image formation section 5 is for forming an image on paper 3. The paper ejection section 6 is for ejecting the paper 3 formed with the image. It is appreciated that aspects of the invention may be used with other types of laser printers including printers with photosensitive belts and/or intermediate transfer belts or drums, for example.

a. Body Casing

The body casing 2 may be shaped substantially as a rectangular box when viewed from the side. The body casing 2 may include a drum housing space 7 to house a drum unit 26.

On one side surface of the body casing 2, an attachment/removal opening 8 is formed to allow access to the drum housing space 7. On the same side surface formed with the attachment/removal opening 8, a front cover 9 is provided to open/close the attachment/removal opening 8. When the front cover 9 is tilted toward the side of the body casing 2, the attachment/removal opening 8 is opened. When the front cover 9 is stood upright along the side surface of the body casing 2, the attachment/removal opening 8 is closed. As such, with the attachment/removal opening 8 left open, the drum unit 26 can be inserted into or removed from the drum housing space 7 via the attachment/removal opening 8.

For reference, the side provided with the front cover 9 (i.e., the right side of FIG. 1) is referred to as front side, and the opposite side (i.e., the left side of FIG. 1) is referred to as rear side. The color laser printer 1 viewed from the front is used as a reference for right and left. As to the drum unit 26 and the developer cartridge 27, unless otherwise specified, the orientation, i.e., front, rear, right, and left, is defined when those are attached to the body casing 2.

b. Paper Feed Section

The paper feed section 4 is provided at the bottom portion in the body casing 2. The paper feed section 4 includes a paper feed tray 10 for storing a quantity of paper 3, a separation roller 11, a separation pad 12, a paper feed roller 13 provided on the rear side of the separation roller 11, and a paper-feed-side conveying path 14 over which the paper 3 passes. The separation roller 11 and the separation pad 12 face each other above the front end portion of the paper feed tray 10.

The paper-feed-side conveying path 14 is shaped substantially like a letter "U" when viewed from the side. The upstream side end portion of the paper-feed-side conveying path 14 is adjacent to the separation roller 11. The downstream side end portion thereof is adjacent from the front side to a conveying belt 58.

At some point of the paper-feed-side conveying path 14, a paper dust removing roller 15 and a pinch roller 16 facing each other are provided above the front side of the separation roller 11. A pair of resist rollers 17 is also provided above the paper dust removing roller 15 and the pinch roller 16.

The paper feed tray 10 is formed therein with a paper pressboard 18, on which the paper 3 is disposed in layers. The paper pressboard 18 is supported at its rear end portion to freely move like a see-saw so that the paper pressboard 18's front end potion is located at a lower position. With such a configuration, the paper pressboard 18 is allowed to move freely between a placement position along the bottom plate of the paper feed tray 10 and a paper-feed position where the front end portion is located at an upper portion and inclined at some angle.

The paper feed tray 10 is provided with a lever 19 at the lower front end portion to lift up the front end portion of the paper pressboard 18. This lever 19 is supported at the lower front end portion of the paper pressboard 18 to freely move like a see-saw in the vertical direction.

When the lever 19 moves like a see-saw, the front end portion of the paper pressboard 18 is lifted by the lever 19, and the paper pressboard 18 is brought to the paper feed position.

When the paper pressboard 18 is brought to the paper feed position as such, the paper 3 at the top on the paper pressboard 18 is pressed by the paper feed roller 13. As the paper feed roller 13 rotates, the paper 3 is directed between the separation roller 11 and the separation pad 12 for paper feeding.

When the paper feed tray 10 is removed from the body casing 2, the paper pressboard 18 moves into a paper placement position. When the paper pressboard 18 is located at the placement position as such, the paper 3 can be placed in layers on the paper pressboard 18.

During feeding, paper 3 is pinched between the separation roller 11 and the separation pad 12 as the separation roller 11 rotates. The paper 3 is then conveyed piece by piece. The paper 3 then passes between the paper dust removing roller 15 and the pinch roller 16. After paper dust is removed, the paper is directed toward the resist rollers 17 along the paper-feed-side conveying path 14.

c. Image Formation Section

The image formation section 5 includes a scanning section 20, a process section 21, an image transfer section 22, and a fixing section 23.

c-1. Scanner Section

The scanner section 20 is disposed above the body casing 2. The scanner section 20 is provided with a support board 24 that extends in the front, rear, right, and left directions. Also, a scanner unit 25 is fixed to the upper surface of the support board 24. The scanner unit 25 includes optical members, e.g., four light sources, a polygon mirror, an fΘ lens, a reflector mirror, a skew correction lens, and others. Laser beams from the light sources based on image data are deflected and scanned by the polygon mirror. The laser beams then pass through both the fΘ lens and the skew correction lens. After being reflected by the reflector mirror, the laser beams are irradiated onto the surfaces of image carriers 29.

c-2. Process Section

The process section 21 is disposed below the scanner section 20 but above the paper feed section 4. The process section 21 includes the drum unit 26 and four developer cartridges 27 corresponding to four various colors.

c-2-1. Drum Unit

The drum unit 26 includes four drum sub units 28 for four various colors (i.e., the drum sub units 28 include a yellow drum sub unit 28Y, a magenta drum sub unit 28M, a cyan drum sub unit 28C, and a black drum sub unit 28K).

The drum sub units 28 are disposed in parallel at regular intervals in the front and rear direction. More specifically, from the front toward the rear, the yellow drum sub unit 28Y, the magenta drum sub unit 28M, the cyan drum sub unit 28C, and the black drum sub unit 28K are disposed in this order.

Figure 3:
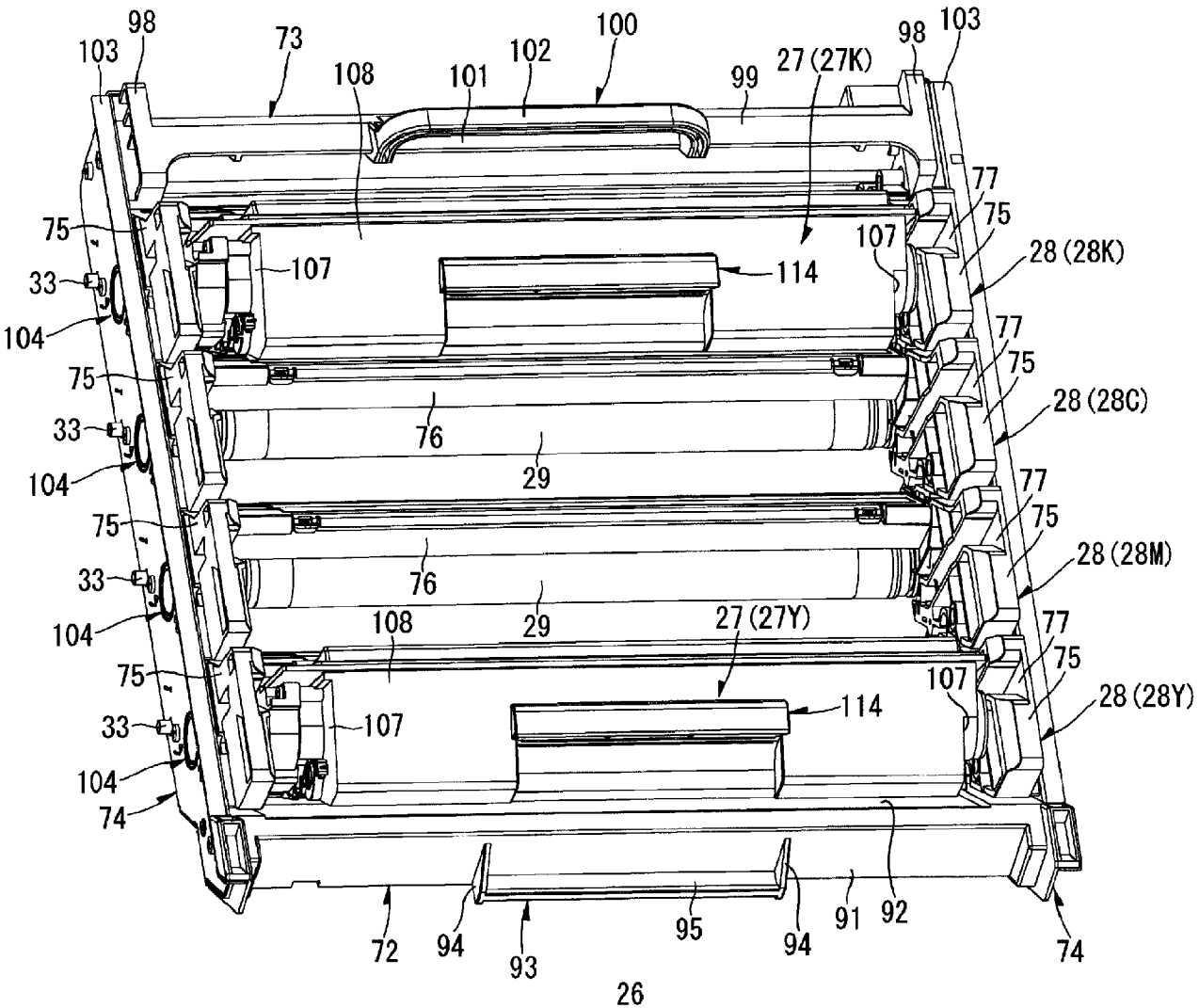
FIG. 3 is a left front perspective view of a drum unit (with two developer cartridges removed) of FIG. 1, viewed from above in accordance with aspects of the present invention.

The drum sub units 28 are each provided with a pair of side frames 75 and a center frame 76 that is disposed between the pair of side frames 75 (as shown in FIG. 3). In FIG. 1, the side frames 75 are schematically shown for the sake of brevity.

Figure 2:
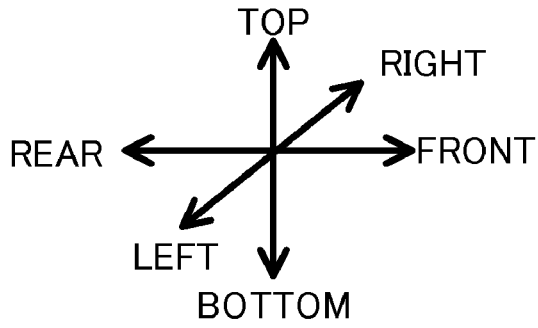
FIG. 2 is a cross sectional side view of a developer cartridge and a drum sub unit as shown in FIG. 1 in accordance with aspects of the present invention.
Figure 2:
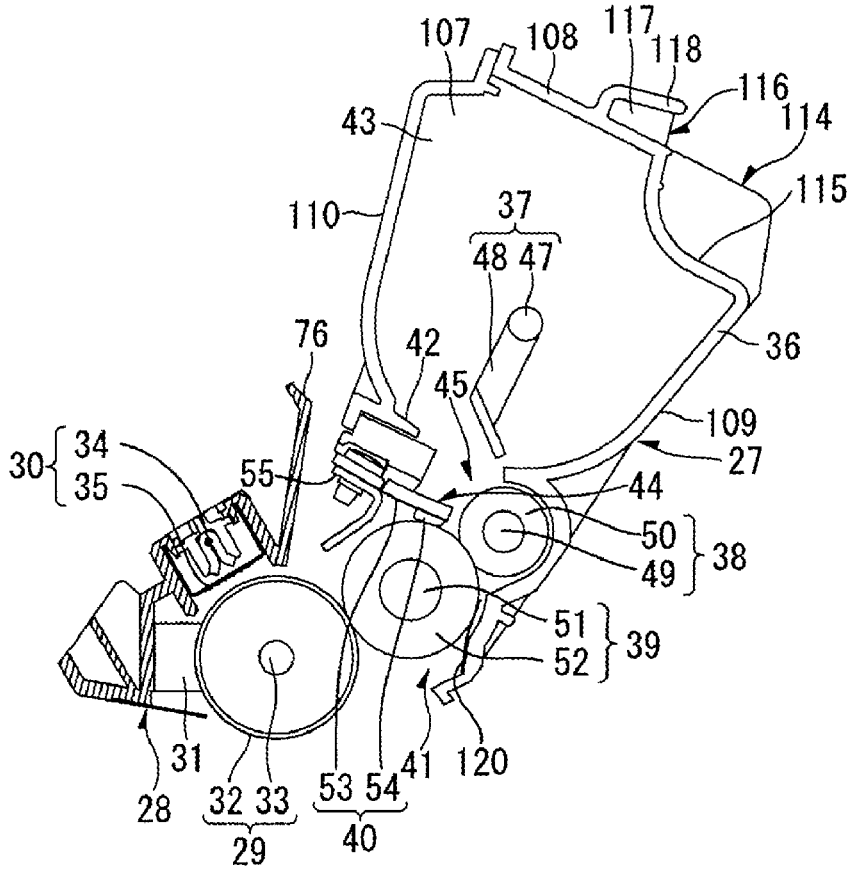

FIG. 2 is a cross sectional side view of the developer cartridge 27 and that of the drum sub unit 28.

As shown in FIG. 2, the drum sub units 28 each hold an image carrier 29, a scorotron charger 30, and a cleaning brush 31.

The image carrier 29 includes a drum body 32 and a drum shaft 33. The drum body 32 is disposed along the lateral direction and is shaped like a cylinder. The outermost layer of the drum body 32 is formed by a positively-charged photosensitive layer made of polycarbonate or other materials. The drum shaft 33 is disposed along the direction of an axis of the drum body 32. The drum body 32 is disposed as to be able to freely rotate against the drum shaft 33. As to the drum shaft 33, both end portions in the axial direction are inserted to the side frames 75 (referring to FIG. 3) and passing therethrough, and are supported by a side plate 74 (referring to FIG. 3) so as to not rotate. The side plate 74 is described below. The image carrier 29 is rotated, at the time of image formation, by a driving force from a motor (not shown) provided inside of the body casing 2.

The scorotron charger 30 is disposed above the image carrier 29 and is held by the center frame 76. Such a scorotron charger 30 includes a discharge wire 34 and a grid 35. The discharge wire 34 is disposed to face the image carrier 29, and the grid 35 is disposed between the discharge wire 34 and the image carrier 29. At the time of image formation, a high voltage is applied to the discharge wire 34 so that corona discharge is generated to the discharge wire 34. At the same time, a voltage is applied to the grid 35, and the surface of the image carrier 29 is uniformly positively charged while the amount of electric charge is controlled as being supplied to the image carrier 29.

The cleaning brush 31 is disposed as to face and come in contact with the image carrier 29 at the rear of the image carrier 29 and is held by the center frame 76. At the time of image formation, a cleaning bias is applied to the cleaning brush 31.

c-2-2. Developer Cartridge

As shown in FIG. 1, the developer cartridges 27 are each removably attached to the corresponding drum sub unit 28 of a predetermined color. Specifically, there are four developer cartridges 27, including a yellow developer cartridge 27Y that is removably attached to the yellow drum sub unit 28Y, a magenta developer cartridge 27M that is removably attached to the magenta drum sub unit 28M, a cyan developer cartridge 27C that is removably attached to the cyan drum sub unit 28C, and a black developer cartridge 27K that is removably attached to the black drum sub unit 28K.

As shown in FIG. 2, the developer cartridges 27 each include a developer frame 36 and components provided inside of the developer frame 36 (i.e., an agitator 37, a supply roller 38, a developer carrier 39, and a layer thickness restriction blade 40).

The developer frame 36 is formed like a box in which an opening section 41 opens at the lower end portion, and a division wall 42 segments the developer frame 36 into a toner accommodating chamber 43 and a developing chamber 44. The division wall 42 is formed with a communicating opening 45 for communicating between the toner accommodating chamber 43 and the developing chamber 44.

The toner accommodating chamber 43 is filled with a toner. More specifically, among the developer cartridges 27, the yellow developer cartridge 27Y is filled with yellow toner, the magenta developer cartridge 27M is filled with magenta toner, the cyan developer cartridge 27C is filled with cyan toner, and the black developer cartridge 27K is filled with black toner.

The toners of various colors are all polymerized, each being a positively-charged nonmagnetic single-component toner. The polymerized toner is of spherical form, and mainly includes a bonding resin that is derived by copolymerizing a styrene monomer or an acrylic monomer by any known polymerization method. The resulting polymerized toner is added with coloring agents of various colors, a charge control agent, a wax, and others, so that toner host particles are formed. For the aim of increasing the flowability, an external additive is also added.

Agitator 37 is provided inside of the toner accommodating chamber 43. The agitator 37 includes an agitator rotation shaft 47 and an agitating member 48. The agitator rotation shaft 47 is supported by both side walls 107 of the developer frame 36 to be able to rotate freely. The agitating member 48 is provided in the axial direction of the agitator rotation shaft 47, and extends from the rotation shaft to the outside of the diameter direction. At the time of image formation, the agitator rotation shaft 47 receives the driving force from the motor (not shown) provided inside of the body casing 2 via an input gear 133 (referring to FIGS. 7 and 8). The agitating member 48 rotates inside of the toner accommodating chamber 43.

In the developing chamber 44, the supply roller 38 is provided below the communicating opening 45. This supply roller 38 includes a supply roller shaft 49 and a sponge roller 50. The supply roller shaft 49 is made of metal, and is supported by the both side walls 107 of the developer frame 36 to be able to rotate freely. The sponge roller 50 is made of a conductive sponge, covering around the supply roller shaft 49. At the time of image formation, the driving force from the motor (not shown) provided inside of the body casing 2 is transmitted to the supply roller shaft 49 via the input gear 133 (referring to FIGS. 7 and 8) so that the supply roller 38 is rotated.

In the developing chamber 44, the developer carrier 39 is provided diagonally below the supply roller 38 toward the rear. This developer carrier 39 includes a developer carrier shaft 51 and a rubber roller 52. The developer carrier shaft 51 is made of metal and is supported by the developer frame 36 to be able to freely rotate. The rubber roller 52 is made of a conductive rubber, covering the developer carrier shaft 51.

The positional relationship of the developer carrier 39 against the supply roller 38 is that the rubber roller 52 abuts the sponge roller 50. The developer carrier 39 is disposed as to be exposed downward from the aperture section 41 of the developing chamber 44.

At the time of image formation, the driving force from the motor (not shown) provided inside of the body casing 2 is transmitted to the developer carrier shaft 51 via the input gear 133 (referring to FIGS. 7 and 8) so that the developer carrier 39 is rotated. To the developer carrier 39, a developer bias is applied.

Inside of the developing chamber 44, the layer thickness restriction blade 40 is provided as to come in contact with the developer carrier 39 with pressure from above. The layer thickness restriction blade 40 includes a blade 53, and a press section 54. The blade 53 is made of a metal leaf spring member. The press section 54 has the semicircular cross section and is made of an insulator silicone rubber. The press section 54 is provided at a free end of the blade 53.

The base end portion of the blade 53 is fixed to the division wall 42 by a fixing member 55, and with the elasticity of the blade 53, the press section 54 provided at the free end portion of the blade 53 is made to contact the rubber roller 52 of the developer carrier 39 with pressure from above.

c-2-3. Developing Operation in Process Section

In the respective developer cartridges 27, the toner of a color filled in the toner accommodating chamber 43 is moved to the communicating opening 45 by its own weight. The toner is then discharged from the communicating opening 45 toward the developing chamber 44 while being agitated by the agitator 37.

After being discharged from the communicating opening 45 to the developing chamber 44, the toner is supplied to the supply roller 38. The toner thus supplied to the supply roller 38 is supplied to the developer carrier 39 by the rotation of the supply roller 38. At this time, the toner is positively charged by friction between the supply roller 38 and the developer carrier 39.

After being supplied to the developer carrier 39, the toner is directed between the press section 54 of the layer thickness restriction blade 40 and the rubber roller 52 of the developer carrier 39 by the rotation of the developer carrier 39. The toner is then settled as a thin film of a fixed thickness on the surface of the rubber roller 52.

On the other hand, in the drum sub unit 28 provided to each of the developer cartridges 27, the scorotron charger 30 generates corona discharge so that the surface of the image carrier 29 is uniformly charged positively.

After being uniformly charged positively as such by the scorotron charger 30, by the rotation of the image carrier 29, the surface of the image carrier 29 is exposed, by high-speed scanning, to laser beams from the scanner section 20, thereby forming an electrostatic latent image corresponding to an image to be formed on the paper 3.

When the image carrier 29 rotates to a further degree, the positively-charged toner settled on the surface of the developer carrier 39 is supplied, by the rotation of the developer carrier 39, to the electrostatic latent image formed on the surface of the image carrier 29. In other words, the toner is supplied to a part of the surface of the image carrier 29 that is exposed by the laser beams and thus becomes low in potential. Through such a toner supply, the electrostatic latent image on the image carrier 29 is developed to be a visible image through developing, and a toner image of various colors is carried on the surface of the image carrier 29.

Note that the toner left on the image carrier 29 is collected by the developer carrier 39 after the toner image is transferred to the paper 3 by the image transfer section 22. Also, any paper dust of the paper 3 attached on the image carrier 29 is collected by the cleaning brush 31 after the toner image is transferred to the paper 3.

c-3. Image Transfer Section

As shown in FIG. 1, in the body casing 2, the image transfer section 22 is disposed above the paper feed section 4 but below the process section 21 along the front and rear direction. This image transfer section 22 includes a drive roller 56, a follower roller 57, the transfer belt 58, an image transfer roller 59, and a cleaning section 60.

The drive roller 56 and the follower roller 57 are disposed face-to-face with a space therebetween in the front and rear direction. The drive roller 56 is disposed at the rear of the black drum sub unit 28K, and the follower roller 57 is disposed at the front of the yellow drum sub unit 28Y.

The transfer belt 58 is of an endless belt and is made of a resin film such as conductive polycarbonate or polyimide with conductive particles such as carbon dispersed. Such a transfer belt 58 is laid across the drive roller 56 and the follower roller 57.

At the time of image formation, the drive roller 56 is provided with the driving force from the motor (not shown) provided inside of the body casing 2, and the drive roller 56 is accordingly rotated. In response, the conveying belt 58 is moved circularly between the drive roller 56 and the follower roller 57 to rotate in the direction opposite to the image carrier 29 at an image transfer position. At the image transfer position, the conveying belt 58 faces and contacts the image carrier 29 of the respective drum sub units 28. The follower roller 57 follows such a movement of the conveying belt 58.

The image transfer roller 59 is provided inside of the conveying belt 58, which is laid across the drive roller 56 and the follower roller 57. The image transfer roller 59 is disposed as to face the corresponding image carrier 29 with the conveying belt 58 sandwiched therebetween. The image transfer roller 59 includes a metal roller shaft, which is covered with a rubber roller made of a conductive rubber. The image transfer roller 59 is disposed at the image transfer position so as to rotate in the same direction as the rotating direction of the conveying belt 58. At the image transfer position, the image transfer roller 59 faces and contacts the conveying belt 58. At the time of image formation, the image transfer roller 59 receives an image transfer bias from a high-voltage substrate (not shown) provided inside of the body casing 2.

The cleaning section 60 is disposed below the conveying belt 58, which is laid across the drive roller 56 and the follower roller 57. The cleaning section 60 includes a primary cleaning roller 61, a secondary cleaning roller 62, a scraping blade 63, and a toner reservoir section 64.

The primary cleaning roller 61 is disposed as to contact the lower transfer belt 58, which is located opposite to the upper transfer belt 58 to which the image carrier 29 and the image transfer roller 59 abut. At the contact position, the primary cleaning roller 61 is disposed as to be driven and rotated in the same direction as the rotating direction of the conveying belt 58. The primary cleaning roller 61 receives a primary cleaning bias at the time of image formation.

The secondary cleaning roller 62 is disposed as to come in contact with the primary cleaning roller 61 from below. At the contact position, the secondary cleaning roller 62 is disposed as to rotate in the direction opposite to the rotating direction of the primary cleaning roller 61. The secondary cleaning roller 62 receives a secondary cleaning bias at the time of image formation.

The scraping blade 63 is disposed as to contact the secondary cleaning roller 62 from below.

The toner reservoir section 64 is disposed below the primary and secondary cleaning rollers 61 and 62 to receive and store therein any toner dripping from the secondary cleaning roller 62.

The paper 3 from the paper feed section 4 is conveyed by the conveying belt 58, which is moved circularly in response to the driving force from the drive roller 56 and the movement of the follower roller 57. The paper 3 is conveyed from the front toward the rear to sequentially pass over the image transfer positions for all of the drum sub units 28. During such paper transfer, the toner images of various colors carried on the image carriers 29 of the drum sub units 28 are sequentially transferred to the paper 3 so that color images are formed on the paper 3.

After a yellow toner image carried on the surface of the image carrier 29 of the yellow drum sub unit 28Y is transferred to the paper 3. For example, a magenta toner image carried on the surface of the image carrier 29 of the magenta drum sub unit 28M is overlaid on the paper 3 on the previously-transferred yellow toner image. Thereafter, similarly, cyan and black toner images follow for an image overlay, i.e., a cyan toner image carried on the surface of the image carrier 29 of the cyan drum sub unit 28C is transferred to the paper 3, and a black toner image carried on the surface of the image carrier 29 of the black drum sub unit 28K. As such, a color image is formed on the paper 3.

After such an image transfer operation, any toner attached on the surface of the transfer belt 58 is, removed from the surface of the conveying belt 58 by the primary cleaning roller 61, the secondary cleaning roller 62, and the scraping roller 63 in the cleaning section 60. The toner removed by these rollers is received and stored in the toner reservoir section 64.

c-4. Fixing Section

The fixing section 23 is disposed to the rear of the black drum sub unit 28K in the body casing 2, and faces the image transfer position in the front and rear direction. The fixing section 23 includes a heat roller 65 and a press roller 66.

The heat roller 65 is made of a metallic tube with a mold release layer formed on the surface, and along the axial direction, a halogen lamp is equipped. By the halogen lamp, the surface of the heat roller 65 is heated to a fixing temperature.

The press roller 66 is disposed below the heat roller 65 to face the heat roller 65. The press roller 66 presses the heat roller 65 from below.

The color image as a result of image transfer on the paper 3 is forwarded to the fixing section 23. As the paper 3 passes between the heat roller 65 and the press roller 66, the color image is thermally fixed to the paper 3. As such, the image formation process places the image onto the paper 3.

d. Paper Ejection Section

In the paper ejection section 6, a paper-ejection-side conveying path 67 for the paper 3 is shaped substantially like a letter "U" when viewed from the side. The paper-ejection-side conveying path 67 includes an upstream side end portion below the fixing section 23 and a downstream side end portion above a paper ejection tray 68. The paper 3 is directed toward the rear side and is ejected toward the front side after the paper 3 is reversed in orientation.

At some point of the paper-ejection-side conveying path 67, a conveying roller 69 and a pinch roller 70 are provided, where the conveying roller 69 and a pinch roller 70 face each other. A pair of paper ejection rollers 71 is located at the downstream side end portion of the paper-ejection-side conveying path 67.

The paper ejection section 6 is provided with the paper ejection tray 68. The paper ejection tray 68 accepts thereon stacks of ejected paper 3. Here, the paper ejection tray 68 is formed into an upper wall of the body casing 2 by recessing the upper wall from the front toward the rear.

The paper 3 from the fixing section 23 is conveyed by the conveying roller 69 and the pinch roller 70 along the paper-ejection-side conveying path 67. The paper 3 is ejected onto the paper ejection tray 68 by the paper ejection rollers 71.

2. Drum Unit

FIG. 3 is a left front perspective view of the drum unit 26 (with two developer cartridges 27 removed), as viewed from above.

The drum unit 26 includes four of the drum sub unit 28 each for a predetermined color, a front beam 72, a rear beam 73, and a pair of side plates 74. The front and rear beams 72 and 73 are disposed on both sides, respectively, in the front and rear direction of the four drum sub units 28. The four drum sub units 28 are disposed in parallel in the front and rear direction. The pair of side plates 74 sandwiches the components (i.e., the front beam 72, the four drum sub units 28, and the rear beam 73) from both sides in the width direction (right and left direction).

The drum unit 26 includes, as a group, the four drum sub units 28, the front and rear beams 72 and 73, and a pair of side plates 74. Such a group is removably attached to the drum housing space 7 in the body casing 2 and slides freely.

a. Drum Sub Unit

The drum sub unit 28 includes a pair of side frames 75 and the center frame 76. The side frames 75 are disposed face-to-face with a space therebetween in the width direction. The center frame 76 is disposed between the side frames 75.

The side frames 75 are each made of a resin material and formed substantially in a rectangular shape when viewed from the side.

The side frames 75 are each formed with a guide groove 77 at inner wall surfaces facing each other in the width direction. The guide groove 77 is provided for guiding the developer cartridge 27 to move to the corresponding drum sub unit 28.

The guide groove 77 is formed to be recessed from the inner wall surface of the side frame 75 toward the outside in the width direction. In the inner wall surface of the side frame 75, the guide groove 77 is formed along in a substantially vertical direction from the upper rear end edge of the side frame 75 extending to the vicinity of the front lower end of the side frame 75. The lower end of the guide groove 77 corresponds to the position of the developer carrier shaft 51 at a position where the developer carrier 39 contacts the image carrier 29. The guide groove 77 accepts therein a collar member 128 of the developer cartridge 27, where the collar member 128 freely slides in the guide groove 77.

Although not shown, coupling inner side insertion holes are formed at the positions facing, in the width direction, the input gear 133 of the developer cartridge attached to the drum sub unit 28. The coupling inner side insertion holds are formed in the side frame 75 on the left side at some point of the guide groove 77, Although not shown in FIG. 3, the side frames 75 each include therein a support section 78 (referring to FIG. 6) at positions corresponding to supported members 124 and 145, respectively, of the developer cartridge 27.

Although not shown in FIG. 3, the side frame 75 on the right side includes therein a power supply member 79 (referring to FIG. 6) at a position corresponding to an electrode member 127 of the developer cartridge 27.

The center frame 76 is made of a resin material and is formed separately from the side frames 75. This center frame 76 is shaped substantially like a slim plate when viewed from above. The upper surface of the center frame 76 is tilted from the front above toward the rear below. As described above, the center frame 76 holds the scorotron charger 30 and the cleaning brush 31 (referring to FIG. 2).

b. Front Beam

The front beam 72 is disposed on the front side of the four drum sub units 28, which are disposed in parallel in the front and rear direction. The front beam 72 is disposed between a pair of side plates 74. This front beam 72 is configured as a unit using a resin material, the unit including a front outer wall 91 and a front inner wall 92. The front outer wall 91 faces the outside of the drum unit 26. The front inner wall 92 faces the inside of the drum unit 26.

The front outer wall 91 is shaped substantially like a slim rectangular plate when viewed from the front, extending in the width direction. The front outer wall 91 is disposed along the vertical direction. The front outer wall 91 includes a front grip section 93 at the center in the width direction. This front grip section 93 includes a pair of grip side plates 94 and a grip center plate 95. The grip side plates 94 are disposed face-to-face with a space therebetween in the width direction. The grip center plate 95 is disposed between such grip side plates 94.

The grip side plates 94 are shaped substantially like triangle plates when viewed from the side, protruding diagonally down toward the front. The grip side plates 94 both protrude from the front wall surface of the front outer wall 91 toward the front.

The grip center plate 95 has a letter "L" cross section with the front end portion bent upward, and is disposed between the lower end portions of the grip side plates 94.

The front inner wall 92 is shaped substantially like a slim rectangular plate when viewed from the rear, extending in the width direction. The front inner wall 92 is disposed at the rear of the front outer wall 91. This front inner wall 92 is tilted in a direction substantially parallel to the upper surface of the center frame 76.

c. Rear Beam

The rear beam 73 is disposed at the rear side of the four drum sub units 28, which are disposed in parallel in the front and rear direction. The rear beam 73 is disposed between a pair of side plates 74. This rear beam 73 is configured as a unit using a resin material and includes a pair of rear side walls 98, a rear link wall 99, and a rear grip section 100. The rear side walls 98 are disposed face-to-face in the width direction. The rear link wall 99 is provided across such a pair of rear side walls 98. The rear grip section 100 protrudes upward from the rear link wall 99.

The rear grip section 100 includes a grip concave section 101 and a rear handle 102. The grip concave section 101 is formed by the upper end portion of the rear link wall 99 being substantially recessed downward when viewed from the rear. The rear handle 102 is shaped like a laterally-inverted letter "U" when viewed from the rear and is coupled to the upper end portion of the rear link wall 99 in such a manner as to be laid across the grip concave section 101 in the width direction.

d. Side Plate

The side plates 74 are provided in a pair so as to sandwich, from the sides in the width direction, the front beam 72, the four drum sub units 28, and the rear beam 73.

The side plates 74 are made of a material whose linear expansion coefficient is lower than that of a resin material forming the drum sub units 28, e.g., metal or fiber reinforced resin (preferably metal). The side plates 74 are each shaped substantially like a slim rectangular plate when viewed from the side, extending in the front and rear direction. With respect to the components disposed in parallel in the front and rear direction (i.e., the front beam 72, the four drum sub units 28, and the rear beam 73), the side plates 74 are each disposed so the front end portion faces the front beam 72, and the rear end portion faces the rear beam 73.

The upper end portions of the side plates 74 are each formed with a collar section 103. The collar section 103 is bent outward in the width direction and extends outwards in the width direction in the front and rear direction. With such a collar section 103, the upper end portion of each of the side walls 74 is shaped with the letter "L" cross section. This collar section 103 meshes to a rail (not shown) provided inside of the body casing 2 and is able to freely slide. When the drum unit 26 is attached to detached from the body casing 2, the collar section 103 is guided to the rail and the drum unit 26 slides in the front and rear direction.

The left side plate 74 is formed with coupling outer side insertion holes 104 in the thickness direction therethrough. The coupling outer side insertion holes 104 are formed at the positions facing, in the width direction, the coupling inner insertion holes (not shown) of the left side frame 75. With such a configuration, the coupling inner side insertion holes are disposed over, in the width direction, and linked to the coupling outer side insertion holes 104. The coupling inner and outer side insertion holes face, in the width direction, the input gear 133 of the developer cartridge 27 attached to the corresponding drum sub unit 28.

3. Developer Cartridge

Figure 4:
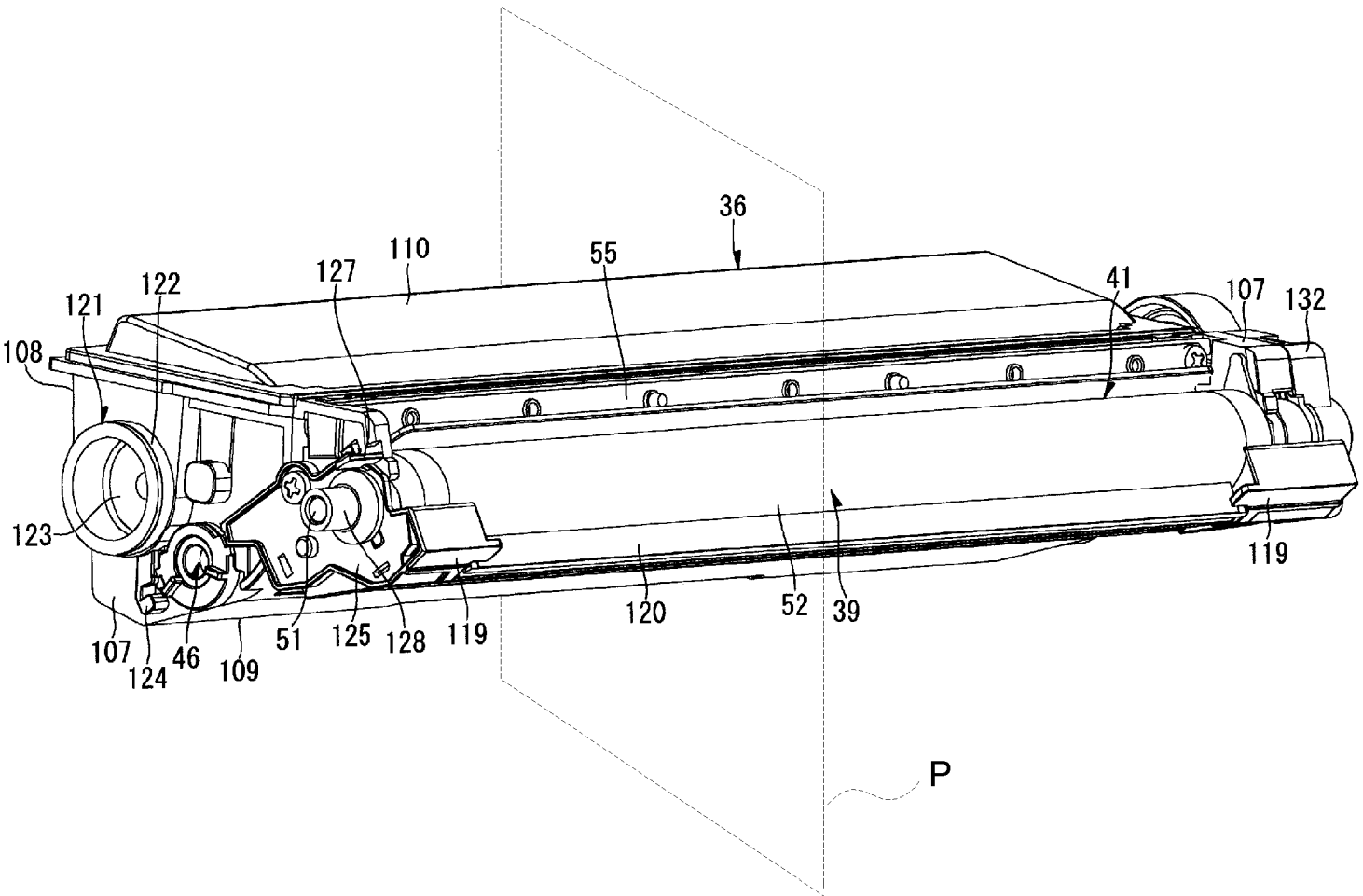
FIG. 4 is a right rear perspective view of the developer cartridge (with a collar member attached) of FIG. 1, viewed from the below in accordance with aspects of the present invention.
Figure 5:
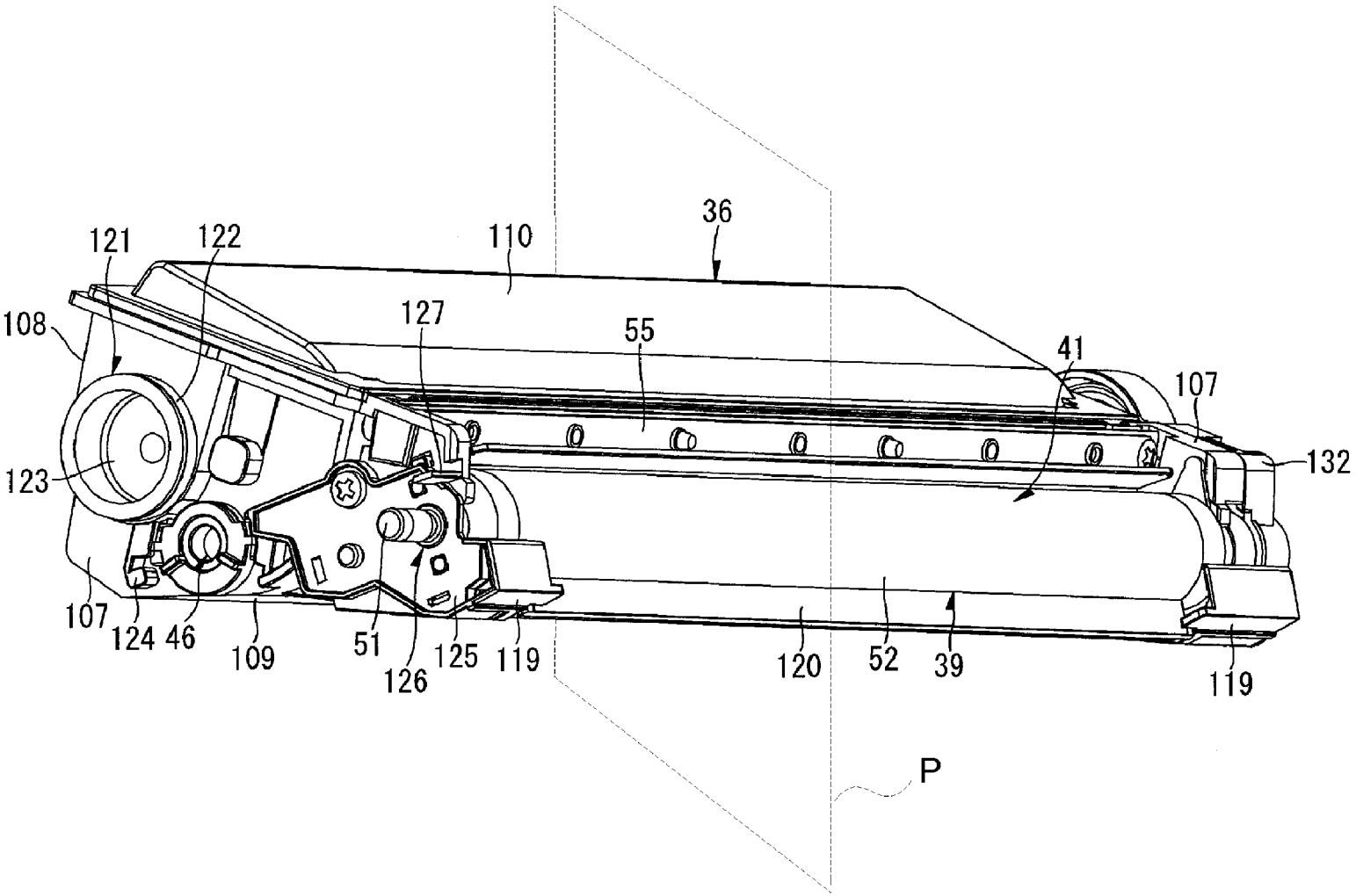
FIG. 5 is a right rear perspective view of the developer cartridge (with no collar member attached) of FIG. 1, viewed from the below in accordance with aspects of the present invention.
Figure 6:
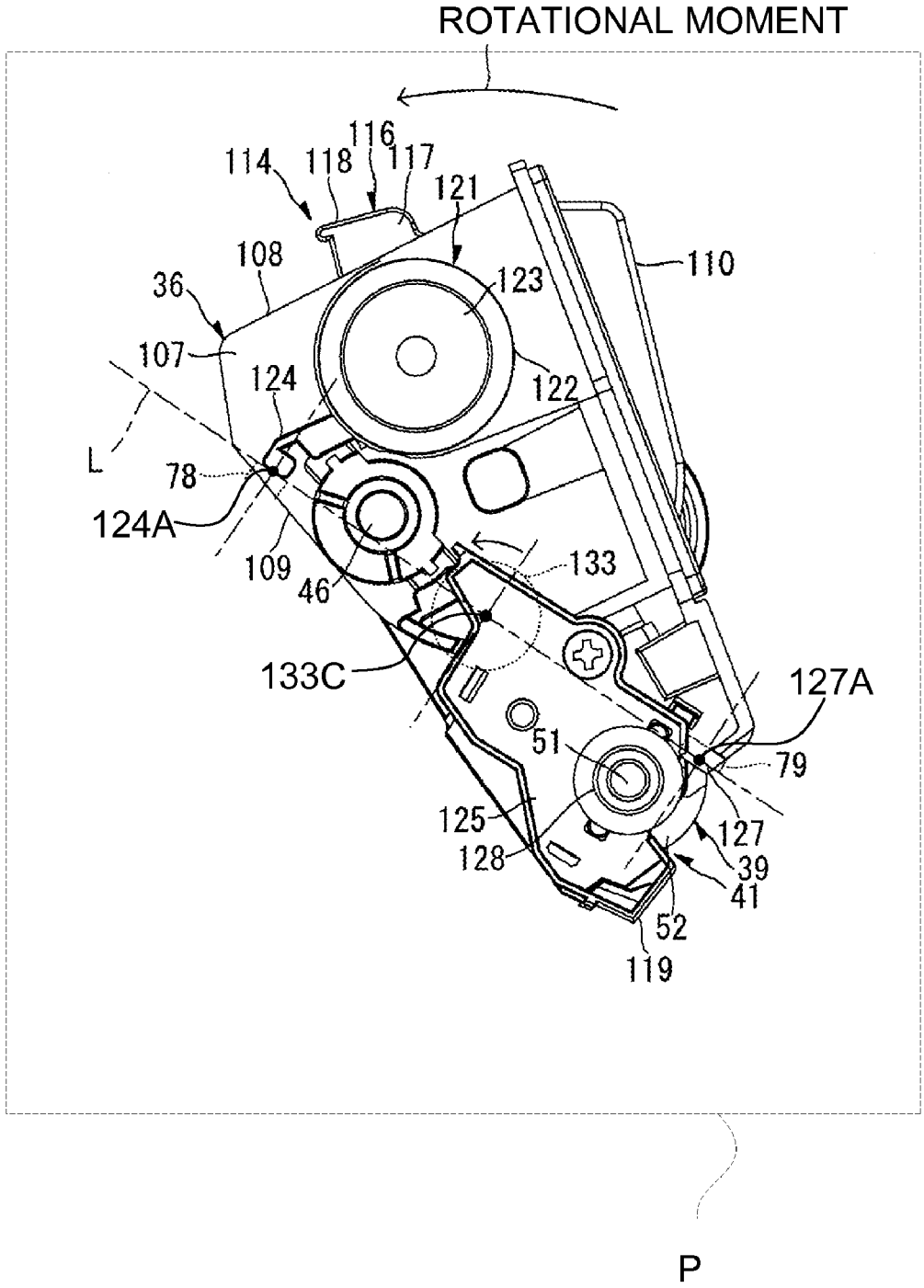
FIG. 6 is a right side view of the developer cartridge of FIG. 4 in accordance with aspects of the present invention.
Figure 7:
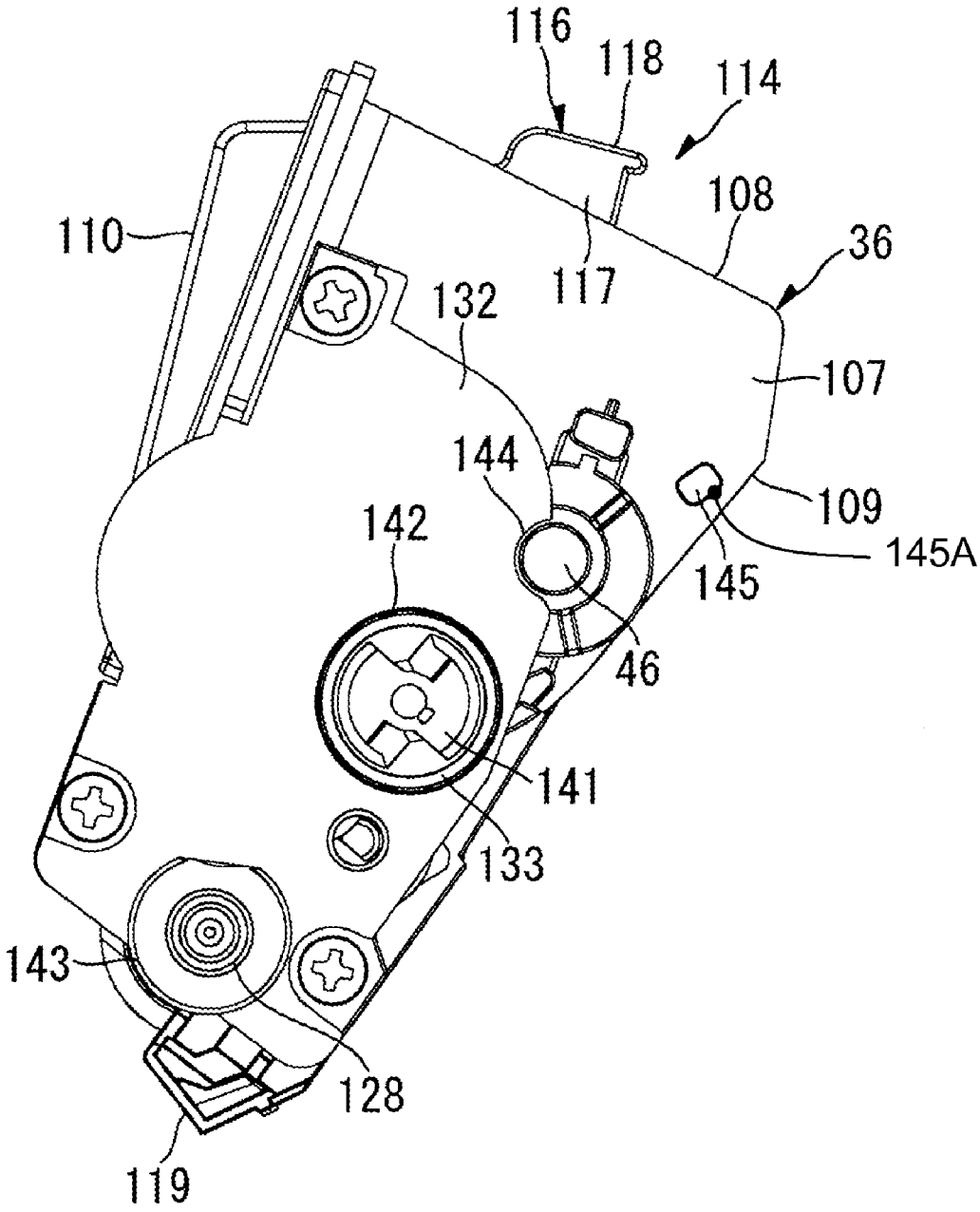
FIG. 7 is a left side view of the developer cartridge (with a gear cover attached) of FIG. 4 in accordance with aspects of the present invention.
Figure 8:
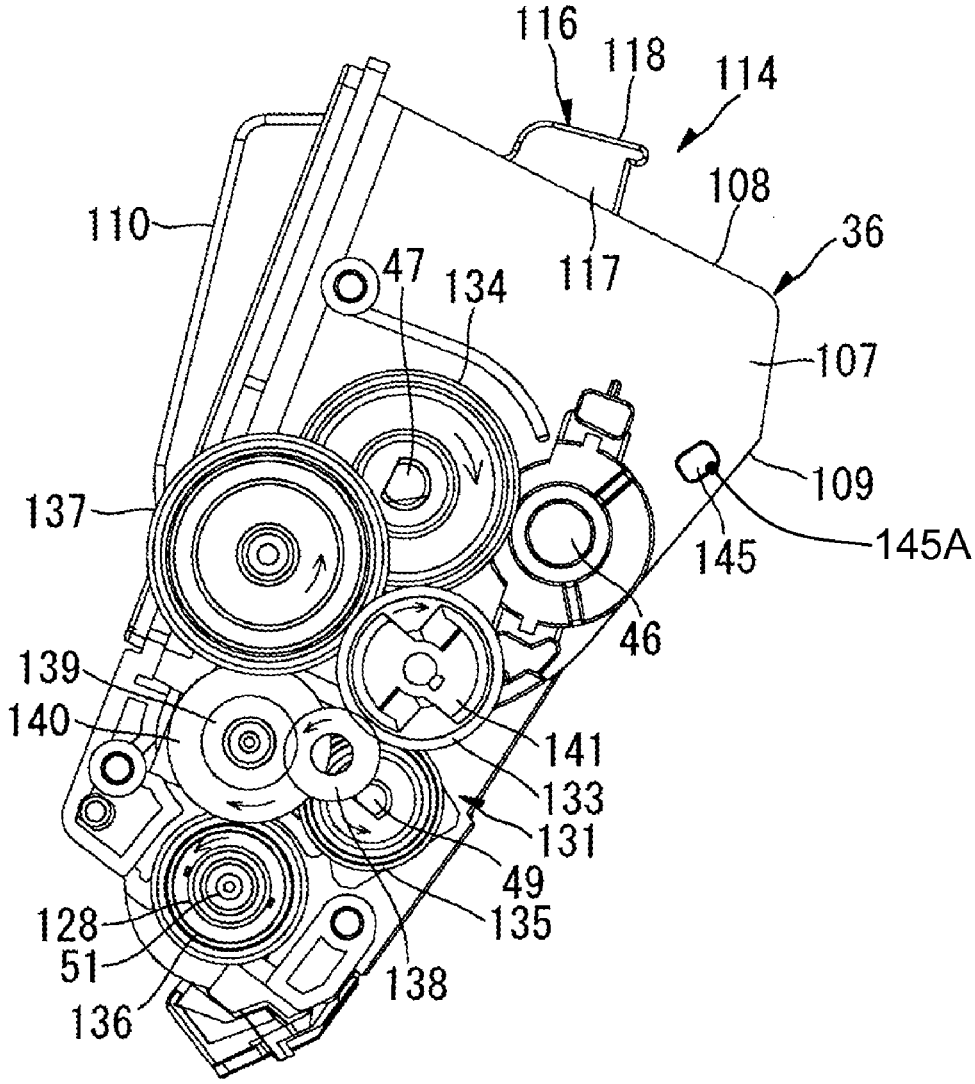
FIG. 8 is a left side view of the developer cartridge (with no gear cover attached) of FIG. 4 in accordance with aspects of the present invention.

FIGS. 4 and 5 are right rear perspective views of the developer cartridge 27 viewed from the below. FIG. 6 is a right side view of the developer cartridge 27. FIGS. 7 and 8 are left side views of the developer cartridge 27.

a. Developer Frame

As shown in FIGS. 4 and 5, the developer frame 36 of the developer cartridge 27 includes, as a group, a pair of side walls 107, an upper wall 108, a front wall 109, and a rear wall 110. The side walls 107 are disposed face-to-face in the width direction. The upper wall 108 is disposed between the upper end edges of the side walls 107. The front wall 109 is disposed between the front end edges of the side walls 107. The rear wall 110 is disposed between the rear end edges of the side walls 107. The developer frame 36 is formed with, at its lower end portion, an opening section 41 by the lower end edges of the side walls 107. The front and rear walls 109 and 110 expose the developer carrier 39 therefrom.

b. Side Wall

As shown in FIGS. 6 and 7, the side walls 107 are each formed with a window 46 that enables the detection of the remaining amount of toner in the toner accommodating chamber 43. The window 46 is embedded at the position slightly above the center of the side wall 107 in the vertical direction and closer to the side of the front wall 109. These windows 46 are disposed to face each other with the toner accommodating chamber 43 therebetween. Light used to detect the remaining amount of toner passes through the windows in the width direction.

b-1. Right Side Wall

As shown in FIGS. 4, 5, and 6, the right side wall 107 is formed with, at the portion above the window 46, a toner filling opening 121 to fill the toner accommodating chamber 43 with a toner. The toner filling opening 121 is provided with a filling opening wall section 122, which is shaped like a cylinder protruding from the side wall 107. The toner filing opening 121 is closed by a cap 123 meshed to the toner filling opening wall section 122.

At the front of the toner filling opening 121, a supported member 124 is formed to extend from the filling opening wall section 122 toward the front. When the developer cartridge 27 is attached to the drum unit 26, the supported member 124 contacts the support member 78 disposed in the side frame 75 of the drum sub unit 28 and is supported by the support member 78. The supported member 124 has a contact point 124A and the supported member 124 contacts with the supporting member 78 at the contact point 124A.

At the lower end portion of the right side wall 107, a bearing member 125 is formed that supports the shaft end portion of the developer carrier shaft 51, allowing the developer carrier shaft 51 to freely rotate. The shaft end portion of the developer carrier shaft 51 protrudes, on the right side, from the bearing member 125. As shown in FIG. 4, the right side of the shaft end portion of the developer carrier shaft 51 is covered from the outside by the collar member 128

The bearing member 125 is made of a plate-like conductive resin. As shown in FIG. 5, bearing member 125 includes a bearing hole 126 at the bearing member 125's lower end portion. The shaft end portion of the developer carrier shaft 51 is inserted through the bearing hole 126. The bearing member 125 is integrally formed with the electrode member 127 at the rear of the bearing hole 126. The electrode member 127 receives from the power supply member 79 a developer bias that is applied to the developer carrier shaft 51.

This electrode member 127 is formed like a thin rectangular plate, protruding outward (rightward) in the width direction from the bearing member 125. The rear surface of the electrode member 127 is disposed extend diagonally down. When the developer cartridge 27 is attached to the drum unit 26, the rear surface of the electrode member 127 contacts the power supply member 79 on the side frame 75 of the drum sub unit 28. The electrode member 127 has a contact point 127A. The electrode member 127 contacts a power supply member 79 at the contact point 127A. FIG. 6 shows components as projected onto imaginary plane P, where imaginary plane P is orthogonal to the rotation axis of the input gear 133. The electrode member 127 is projected on imaginary plane P along with the supported member 124 and the input gear 133. The electrode member 127 is disposed so that an imaginary line L that connects the contact point 124A and the contact point 127A passes a rotating center 133C of the input gear 133. When the components (i.e., the electrode member 127, the supported member 124, and the input gear 133), are projected on the imaginary plane P, the contact point 124A and the contact point 127A are both disposed as to be substantially symmetric with respect to the rotating center 133C of the input gear 133.

b-2. Left Side Wall

As shown in FIG. 8, various shaft end sections are protruding from the left side wall 107 (i.e., those of the agitator rotation shaft 47, the supply roller shaft 49, and the developer carrier shaft 51). The left side wall 107 is provided with a gear mechanism 131 and a gear cover 132. The gear mechanism 131 is provided for rotating and driving such shafts (i.e., the agitator rotation shaft 47, the supply roller shaft 49, and the developer carrier shaft 51). The gear mechanism 131 is covered by the gear cover 132 as shown in FIG. 7.

As shown in FIG. 8, the gear mechanism 131 includes the input gear 133, an agitator drive gear 134, a supply roller drive gear 135, a developer carrier drive gear 136, and intermediate gears 137, 138, 139, and 140.

The input gear 133 is provided at the center of the left side wall 107 in the vertical direction closer to the side of the front wall 109. When the components (i.e., the supported member 124, the electrode member 127, and the input gear 133), are projected on the imaginary plane P, the input gear 133 is rotatably supported at the position on which the imaginary line L passes the rotating center of the input gear 133. That is, the rotating center 133C is located on the imaginary line L. The imaginary line L passes over the contact point 124A and the contact point 127A on the imaginary plane P.

The input gear 133 includes a coupling passive section 141 to which a coupling shaft (not shown) (provided inside of the body casing 2) is coupled so as to not to rotate relative to the input gear 133. The coupling passive section 141 is formed with gear teeth on the outer circumferential surface. The coupling shaft is provided with the driving force from the motor (not shown) provided inside of the body casing 2. The input gear 133 is coupled with the coupling shaft and rotates together with the coupling shaft by the driving force from the motor in a clockwise direction when viewed from the left (i.e., counterclockwise direction when viewed from the right).

The agitator drive gear 134 is provided at the shaft end portion of the agitator rotation shaft 47 and is disposed above the input gear 133.

The supply roller drive gear 135 is provided at the shaft end portion of the supply roller shaft 49.

The developer carrier drive gear 136 is provided at the shaft end portion of the developer carrier shaft 51.

The intermediate gear 137 is disposed at the rear of the input gear 133 and the agitator drive gear 134. The intermediate gear 137 meshes with the input gear 133 and the agitator drive gear 134.

The intermediate gear 138 is disposed below the intermediate gear 137. The intermediate gear 138 meshes with the input gear 133.

The intermediate gear 139 is disposed at the rear of the intermediate gear 138 and meshes with the intermediate gear 138.

The intermediate gear 140 is provided coaxial to the intermediate gear 139 and is integrally provided to the intermediate gear 139. This intermediate gear 140 meshes with the supply roller drive gear 135 and the developer carrier drive gear 136.

As shown in FIG. 7, the gear cover 132 is attached to the side wall 107 as if covering the gear mechanism 131 from outside in the width direction. This gear cover 132 is formed with an input port 142 at the position facing the input gear 133 to expose the input gear 133 therefrom. The gear cover 132 is formed with an insertion notch section 143 through which the shaft end portion of the developer carrier shaft 51 is inserted. The gear cover 132 includes a window notch section 144 from which the window 46 is exposed.

The left-side shaft end portion of the developer carrier shaft 51 protrudes laterally (leftward) in the width direction from the gear cover 132. As shown in FIG. 7, the left-side shaft end portion of the developer carrier shaft 51 is covered from the outside by the collar member 128 shaped substantially like a cylinder.

The left side wall 107 is formed with a block-shaped supported member 145 diagonally above the window 46 toward the front. When the developer cartridge 27 is attached to the drum unit 26, the supported member 145 contacts the supporting member 78 disposed in the side frame 75 of the drum sub unit 28. The supported member 145 is supported by the supporting member 78. The supported member 145 has a contact point 145A. The supported member 145 contacts the supporting member 78 at the contact point 145A. This supported member 145 is disposed that, when projected on the imaginary plane P together with the electrode member 127 and the input gear 133, the imaginary line L passes the contact point 145A. That is, the supported member 145 is disposed as to face, in the width direction, the supported member 124 provided on the right side wall 107. When the supported member 145 is projected on the imaginary plane P together with the electrode member 127 and the input gear 133, the contact point 145A and the contact point 127A are both disposed as to be substantially point symmetric with respect to the rotating center 133C of the input gear 133.

c. Upper Wall

As shown in FIGS. 2, 6, 7, and 8, the upper wall 108 is provided with a developer cartridge grip section 114. This developer cartridge grip section 114 is provided at the center of the upper wall 108 of the developer frame 36 in the width direction. As shown in FIG. 2, the developer cartridge grip section 114 includes a concave section 115 and a handle 116. The concave section 115 is formed by the upper wall 108 of the developer frame 36 being recessed downward. The handle 116 is provided at the rear end portion of the concave section 115.

The concave section 115 is shaped substantially like a rectangular recess when viewed from above, and the front end portion is notched to open toward the front.

The handle 116 is disposed as to extend in the width direction at the rear end portion of the concave section 115. This handle 116 includes grip side walls 117 and a grip center wall 118. The grip side walls 117 sandwich the concave section 115 therebetween in the width direction and the grip center wall 118 is disposed between the grip side walls 117.

The grip side walls 117 are each shaped like a triangle when viewed from the side, being reduced in width toward the rear. The grip side walls 117 are each formed as to extend upward from the both end portions of the concave section 115 in the width direction. The grip center wall 118 is disposed between the upper end edges of the grip side walls 117.

As such, a user can pull out the developer cartridge 27 in the upward direction by holding the developer cartridge grip section 114.

d. Front Wall

As shown in FIGS. 4 and 5, the lower end portion of the front wall 109 is provided with a side end front wall 119 at each end portion in the width direction. The side end front wall 119 is formed as to extend downward and bend toward the rear (i.e., has the substantially letter "L" cross section).

Along the lower end edge of the front wall 109, a lower film 120 is attached. This lower film 120 is formed of a polyethylene terephthalate film and is disposed that the upper end portion contacts the surface of the rubber roller 52 of the developer carrier 39 with the lower end portion attached to the front wall 109. This accordingly closes a space between the front wall 109 and the developer carrier 39, thereby preventing toner leakage from the developer carrier 39.

e. Rear Wall

As shown in FIG. 2, the division wall 42 is formed at the lower end portion of the rear wall 110 as to be orthogonal to the lower end edge of the rear wall 110 and extend along the lower end edge thereof. The division wall 42 is attached with the fixing member 55 having the substantially letter "L" cross section. There is a base end portion of the blade 53 of the layer thickness restriction blade 40 between the fixing member 55 and the division wall 42.

4. Attachment of Developer Cartridge to Drum Unit

The developer cartridge 27 is attached to the corresponding drum sub unit 28 along substantially the vertical direction from the above of the drum unit 26.

To be more specific, for such attachment, the collar member 128 provided at each end portion of the developer carrier shaft 51 of the developer cartridge 27 in the axial direction is inserted to the guide groove 77. The guide groove 77 is formed in each of the side frames 75 of the corresponding drum sub unit 28. The developer cartridge 27 is then pushed downward against the drum sub unit 28 in such a manner that the collar members 128 at the both end portions of the developer carrier shaft 51 in the axial direction slide along the guide grooves 77. When the collar members 128 at the both end portions of the developer carrier shaft 51 in the axial direction contact the deepest portion of the guide groove 77, the developer cartridge 27 is prevented from moving further so that the developer carrier 39 contacts the image carrier 29.

In response thereto, the supported members 124 and 145 provided to the side walls 107 of the developer frame 36 contact the supporting member 78 provided to each of the side frames 75 from the upstream side in the rotation direction of the input gear 133, i.e., counterclockwise direction when viewed from the right. The supported members 124 and 145 are both supported by the supporting member 78. As such, the developer cartridge 27 is attached to the corresponding drum sub unit 28.

When the developer cartridge 27 is attached to the drum sub unit 28, as shown in FIG. 6, the electrode member 127 provided on the right side wall 107 contacts a power supply member 79 provided on the right side frame 75 from the upstream side in the rotation direction (i.e., counterclockwise direction when viewed from the right, of the input gear 133).

When the developer cartridge 27 is attached to the drum sub unit 28, the input gear 133 exposing from the gear cover 132 provided to the left side wall 107 faces, in the width direction, the coupling inner side insertion hole formed to the left side frame 75 and the coupling outer side insertion hole 104 formed to the left side plate 74.

5. Effects

When the drum unit 26 attached with the developer cartridges 27 for various colors is attached to the body casing 2, the coupling shaft (not shown) provided inside of the body casing 2 for each of the colors faces the coupling outer side insertion holes 104 in the width direction. When such coupling shafts are directed to the coupling outer side insertion holes 104, the coupling shafts are coupled to the input gear 133. By providing the input gear 133 in such a state with the driving force of the motor via the coupling shafts, the agitator 37, the supply roller 38, and the developer carrier 39 are accordingly driven.

That is, as shown in FIG. 8, when the rotation force is provided from the coupling shafts to the input gear 133 in the clockwise direction when viewed from the left, the rotation of the input gear 133 is transmitted to the agitator drive gear 134 via the intermediate gear 137 so that the agitator drive gear 134 is rotated and driven in the clockwise direction when viewed from the left. With the rotation of the agitator rotation shaft 47 as such, the agitator 37 is rotated. The rotation of the input gear 133 is also transmitted to the intermediate gear 139 via the intermediate gear 138. Also, the intermediate gear 139 is rotated in the clockwise direction when viewed from the left. Together with the intermediate gear 139, the intermediate gear 140 is rotated, and the rotation force of the intermediate gear 140 is transmitted to the supply roller drive gear 135 so that the supply roller drive gear 135 is rotated in the counterclockwise direction when viewed from the left. In response to the rotation of the supply roller shaft 49, the supply roller 38 is rotated. The rotation force of the intermediate gear 140 is transmitted to the developer carrier drive gear 136 so that the developer carrier drive gear 136 is rotated in the counterclockwise direction when viewed from the left. In response to the rotation of the developer carrier shaft 51, the developer carrier 39 is rotated.

At this time, as shown in FIG. 6, the developer cartridge 27 is exposed to a rotational moment in the rotation direction of the input gear 133, i.e., counterclockwise direction when viewed from the right, relative to the input gear 133. With the rotational moment, the supported members 124 and 145 of the developer cartridge 27 are pressed against the supporting member 78 of the drum unit 26, and the electrode member 127 of the developer cartridge 27 is pressed against the power supply member 79 of the drum unit 26.

With the configuration of the illustrative embodiment, when the supported members 124 and 145, the electrode member 127, and the input gear 133 are projected on the imaginary plane P, these components (i.e., the contact point 124A and 145A, the contact point 127A, and the rotating center 133C of the input gear 133) are disposed on the same imaginary line L. Also, the contact point 124A and the contact point 127A are both disposed as to be substantially symmetric with respect to the rotating center 133C of the input gear 133. Further, the contact point 145A and the contact point 127A are both disposed as to be substantially symmetric with respect to the rotating center 133C of the input gear 133. As such, the rotational moment at the positions of the supported members 124 and 145 can be cancelled out by the rotational moment at the position of the electrode member 127. That is, the thrust forces are equivalent but are directed in opposite directions (i.e., the thrust force provided by the supported members 124 and 145 to the supporting member 78 by the rotational moment of the developer cartridge 27 and the thrust force provided by the electrode member 127 to the power supply member 79 by the rotational moment of the developer cartridge 27). These thrust forces are sufficiently cancelled out. As such, the developer cartridge 27 is supported in a stable manner.

When the supported members 124 and 145, the electrode member 127, and the input gear 133 are projected on the imaginary plane P, these components (i.e., the contact points 124A and 145A, the electrode member 127, and the input gear 133) are not necessarily disposed at positions being substantially symmetric with respect to the rotating center 133C of the input gear 133 as long as these components are disposed on the imaginary same line L. This is because, even if such components are not substantially symmetric with respect to the rotating center 133C of the input gear 133, the thrust force provided by the supported members 124 and 145 to the supporting member 78 by the rotational moment of the developer cartridge 27 can be cancelled out by the thrust force provided by the electrode member 127 to the power supply member 79 by the rotational moment of the developer cartridge 27. Therefore, the developer cartridge 27 can be prevented from being unsteady in posture.

Further, with the configuration (i.e., the supported members 124 and 145 are provided to the both side walls 107 of the developer cartridge 27 and the supporting member 78 is provided to each of the side frames 75 that are disposed face-to-face in the width direction), the developer cartridge 27 can be stably supported at two points in the width direction. As such, the posture of the developer cartridge 27 can be made even more stable.

Still further, because the electrode member 127 is integrally provided with the bearing member 125, the number of components can be reduced and simplified in configuration compared with the configuration in which the electrode member 127 and the bearing member 125 are separately provided.

The process section 21 includes therein the developer cartridge 27 that can remain steady in posture when a rotation force is input to the input gear 133, whereby achieving a good development. The surface of the image carrier 29 can be thus formed with high-quality toner images.

Further, because the color laser printer 1 is provided with such a process section 21, the surface of the image carrier 29 can be thus formed with high-quality toner images, and the paper 3 can be formed with high-quality images.

6. Another Illustrative Embodiment

Figure 9:
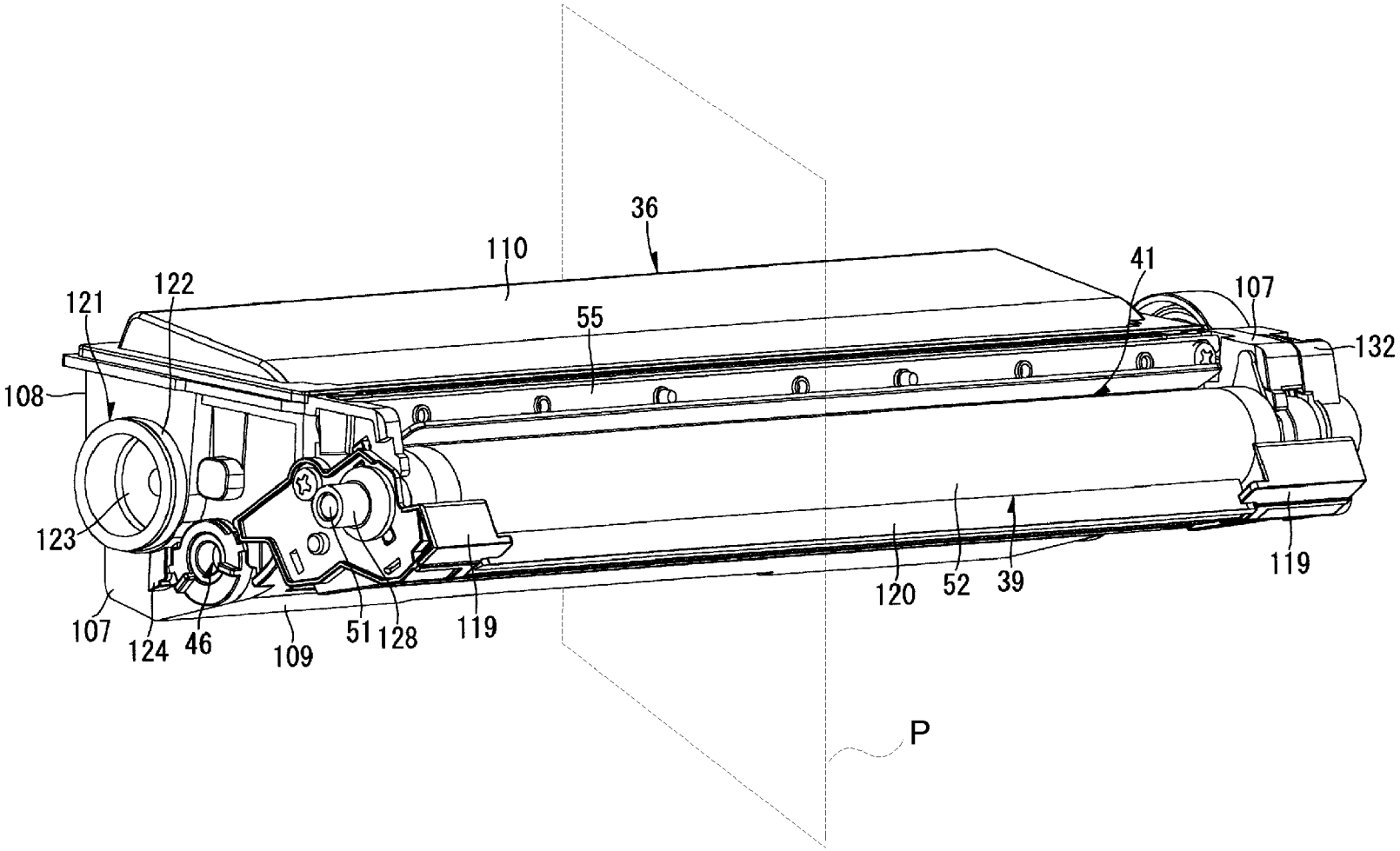
FIG. 9 is a right rear perspective view of another illustrative embodiment of a developer cartridge, viewed from the below in accordance with aspects of the present invention.
Figure 10:
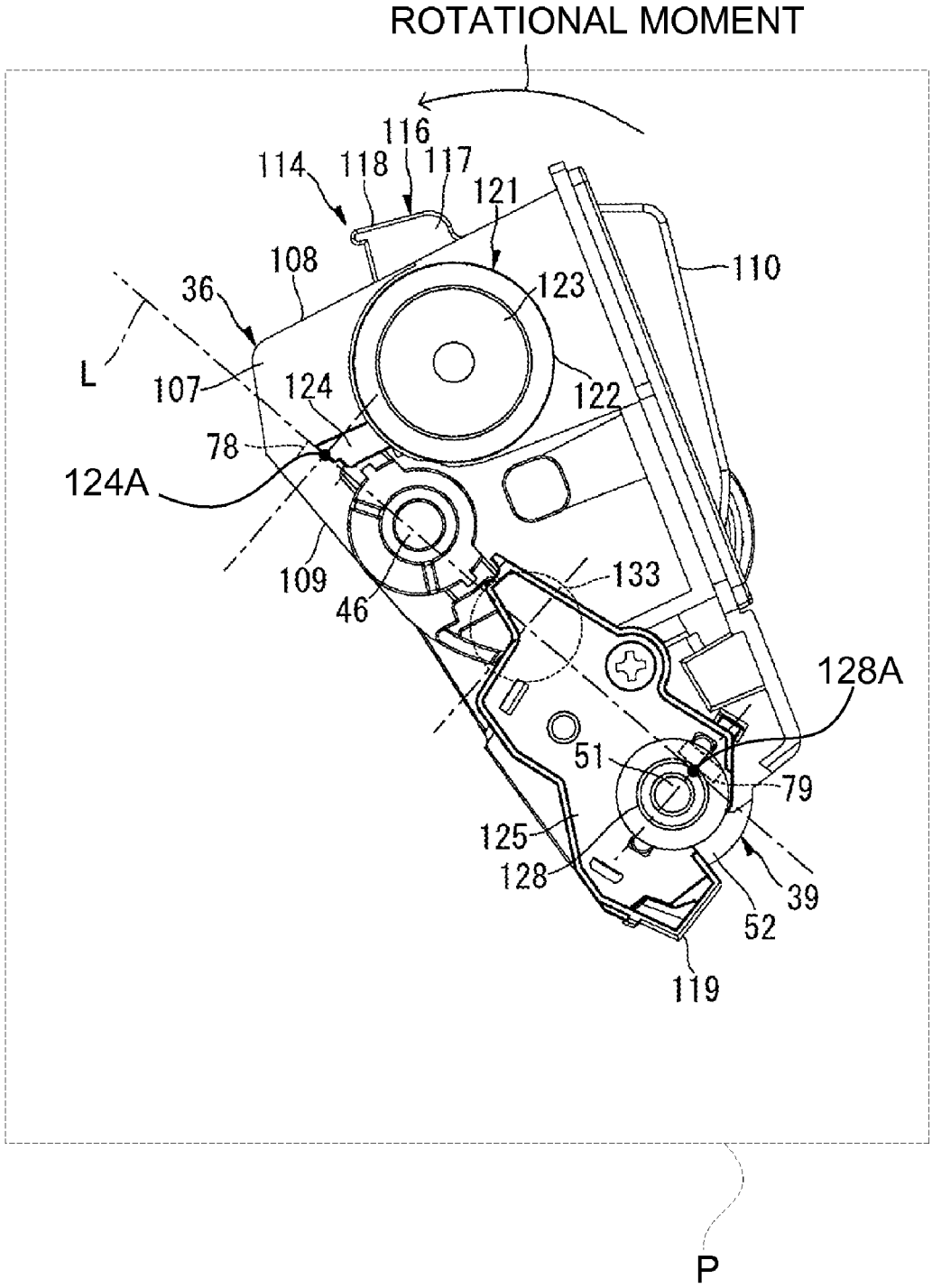
FIG. 10 is a right side view of the developer cartridge of FIG. 9 in accordance with aspects of the present invention.

FIG. 9 is a right perspective view of another illustrative embodiment of the developer cartridge 27 viewed from the below. FIG. 10 is right side view of the developer cartridge 27 of FIG. 9. In FIGS. 9 and 10, components having the same structure as described above are provided with the same reference numerals and are not described in detail.

The developer cartridge 27 of FIGS. 9 and 10 includes no electrode member 127. Rather, the collar member 128 covering, from outside, the right-side shaft end portion of the developer carrier shaft 51 serves as the electrode member.

The collar member 128 is made of a conductive material. The collar member 128 contacts the power supply member 79 provided to the drum unit 26 when the developer cartridge 27 is attached to the drum unit 26. The collar member 128 has a contact point 128A. The collar member 128 contacts the power supply member 79 at the contact point 128A.

The supported member 124 is formed substantially like a parallelogram when viewed from the side.

The bearing member 125 is made of a non-conductive resin.

As shown in FIG. 10, when the supported members 124 and 145, the collar member 128, and the input gear 133 are projected on the imaginary plane P, these components (i.e., the contact points 124A and 145A, the contact point 128A, and the rotating center 133C of the input gear 133), are disposed on the same imaginary line L. Also, the contact points 124A and 145A and the contact point 128A are disposed as to be substantially symmetric with respect to the rotating center 133C of the input gear 133.

Such a configuration also achieves the effects similar to the configuration of the developer cartridge 27 of FIG. 6. Because the collar member 128 serves also as an electrode member, the components can be reduced in number, a bias can be applied to the developer carrier 39, and the shaft end portion of the developer carrier shaft 51 can be protected.

7. Modified Example

In the above-described illustrative embodiment, the drum unit 26 may be removably attached to the body casing 2 and the drum unit 26 used with various colors. Alternatively, the drum unit 26 may be fixed to the body casing 2, an upper surface cover may be provided to open/close the upper surface of the body casing 2, and the developer cartridges 27 may be directly attached to detached from the body casing 2. If this is the case, the configuration may not be provided with the front beam 72, the rear beam 73, and a pair of side plates 74. Also, the drum sub units 28 may be attached to the side surface of the body casing 2. That is, the drum unit 26 may not be provided, and the drum sub units 28 may be fixed inside of the body casing 2. Also, power supply member 79, the supported member 124 and the supported member 145 may be disposed at the body casing 2.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Numerous other embodiments, modifications and variations within the scope.

What is claimed is:

1. A developer cartridge for use with an image forming unit, the developer cartridge comprising:

a developer carrier;

an input gear rotatable about a rotating axis, the input gear communicating with the developer carrier;

an electrode member being electrically connected with the developer carrier, the electrode member including a first contact where the electrode member contacts a power supply member provided in the image forming unit; and a supported member that includes a second contact where the supported member is supported by a supporting member provided in the image forming unit, wherein an imaginary plane is formed orthogonal to the rotating axis of the input gear, the imaginary plane including projections of the input gear, the electrode member, and the supported member, and wherein an imaginary line connects the first contact and the second contact on the imaginary plane, and the imaginary line passes the input gear on the imaginary plane where the input gear is located between the first contact and second contact on the imaginary plane.

2. The developer cartridge according to claim 1, wherein the imaginary line passes a rotating center of the input gear.

3. The developer cartridge according to claim 2, wherein the first contact and the second contact are located to be substantially symmetric with respect to the rotating center of the input gear.

4. The developer cartridge according to claim 1, wherein the electrode member is configured to be disposed at an upstream position in the rotation direction of the input gear with respect to the power supply member and wherein the supported member is configured to be disposed at an upstream position in the rotation direction of the input gear with respect to the supporting member, when the developer cartridge is attached to the image forming unit.

5. The developer cartridge according to claim 1, further comprising:

a casing that includes a first wall supporting a shaft end of the developer carrier and a second wall supporting another shaft end of the developer carrier, wherein the supported member is provided to each of the first and second developer walls.

6. The developer cartridge according to claims 1, further comprising:

a protection member for protecting a shaft end of the developer carrier, wherein the electrode member is the protection member.

7. The developer cartridge according to claims 1, further comprising:

a bearing member for supporting a shaft end portion of the developer carrier, wherein the electrode member is the bearing member.

8. The developer cartridge according to claim 1, further comprising:

a casing supporting the developer carrier, wherein the electrode member is disposed at the casing so as to protrude in an axis direction of the developer carrier.

9. The developer cartridge according to claim 1, further comprising:

a casing supporting the developer carrier, wherein the supported member is disposed at the casing so as to protrude in an axis direction of the developer carrier.

10. The developer cartridge according to claims 1, wherein the image forming unit is drum unit that includes at least one photosensitive drum.

11. A process unit that is attached to and detached from an image formation device, the process unit comprising:

a drum unit supporting at least one of image carrier;

a power supply member;

a supporting member; and a developer cartridge attached to and detached from the drum unit, the developer cartridge including:

a developer carrier;

an input gear rotatable about a rotating axis, the input gear communicating with the developer carrier;

an electrode member that is electrically connected with the developer carrier, the electrode member including a first contact where the electrode member contacts the power supply member; and a supported member that includes a second contact where the supported member is supported by the supporting member, wherein an imaginary plane is defined as orthogonal to the rotating axis of the input gear, the imaginary plane including projections of the input gear, the electrode member, and the supported member, and wherein an imaginary line is define as connecting the first contact and the second contact in the imaginary plane, the imaginary line passing through the input gear on the imaginary plane as the input gear is located between the first contact and second contact on the imaginary plane.

12. The process unit according to claim 11, further comprising:

a first unit wall supporting a shaft end of the image carrier and a second unit wall supporting another shaft end of the image carrier, wherein the supporting member is provided to each of the first and second unit wall.

13. An image formation device comprising:

a body;

at least one of image carrier supported at the body;

a power supply member;

a supporting member; and a developer cartridge attached to and detached from the image formation device, the developer cartridge including:

a developer carrier;

an input gear rotatable about a rotating axis, the input gear communicating with the developer carrier;

an electrode member that is electrically connected with the developer carrier, the electrode member including a first contact where the electrode member contacts the power supply member; and a supported member that includes a second contact where the supported member is supported by the supporting member, wherein an imaginary plane is defined orthogonal to the rotating axis of the input gear, the imaginary plane including projections of the input gear, the electrode member, and the supported member, and an imaginary line is defined as connecting the first contact and the second contact in the imaginary plane, the imaginary line passing through the input gear on the imaginary plane, where the input gear is located between the first contact and second contact in the imaginary plane.

* * * * *